US010433625B1

(12) United States Patent
Belizaire

(10) Patent No.: US 10,433,625 B1
(45) Date of Patent: Oct. 8, 2019

(54) FITTED CAP CASE

(71) Applicant: Ednick Belizaire, Miami, FL (US)

(72) Inventor: Ednick Belizaire, Miami, FL (US)

( * ) Notice: Subject to any disclaimer, the term of this patent is extended or adjusted under 35 U.S.C. 154(b) by 0 days.

(21) Appl. No.: 15/860,390

(22) Filed: Jan. 2, 2018

(51) Int. Cl.
*B62D 43/00* (2006.01)
*A45C 11/02* (2006.01)

(52) U.S. Cl.
CPC ..... *A45C 11/02* (2013.01)

(58) Field of Classification Search
CPC ..... B65D 85/18; A45C 11/02; A45C 11/00
USPC ..... 206/8, 278; 223/24, 84
See application file for complete search history.

(56) References Cited

U.S. PATENT DOCUMENTS 5,022,515 A 6/1991 Agostine
5,348,166 A 9/1994 Lema
5,480,023 A * 1/1996 Puller ..... A45C 7/0063 190/103
5,813,546 A 9/1998 Wilson et al.
5,823,328 A * 10/1998 Fomby ..... A45C 11/02 206/8
6,125,997 A * 10/2000 Campbell ..... A45C 11/02 206/278
6,273,274 B1 8/2001 Lyles
6,510,972 B1 * 1/2003 Briskey ..... A42B 1/002 223/24
6,968,985 B1 * 11/2005 Caccavallo ..... A42B 1/002 223/24
7,147,112 B2 12/2006 Penson
D544,207 S 6/2007 Lindars
7,980,433 B2 * 7/2011 Wynn ..... A42C 1/04 223/24
D653,272 S * 1/2012 Wynn ..... D15/199
8,220,673 B1 * 7/2012 Levin ..... D06F 95/008 206/8
8,701,954 B1 * 4/2014 Weinmeister ..... B60R 7/10 206/8
9,161,599 B1 * 10/2015 Shelton ..... A45C 11/02
9,706,824 B2 * 7/2017 Tuning ..... A45C 11/02
2005/0211547 A1 * 9/2005 Hanawa ..... C23C 14/0036 204/192.12
2005/0211574 A1 * 9/2005 Reeve ..... A45C 11/02 206/8
2009/0166388 A1 * 7/2009 Bryant ..... A42B 1/002 223/25

* cited by examiner

*Primary Examiner* — Fenn C Mathew
*Assistant Examiner* — Cynthia F Collado
(74) *Attorney, Agent, or Firm* — Albert Bordas, P.A.

(57) ABSTRACT

A fitted cap case that has a cap cover assembly having a front cover and a rear cover, a cap base assembly having a front base and a rear base, and a bottom base assembly having a front bottom base and a rear bottom base. The front cover closes onto the front base. The rear base and the rear bottom base slide within a cavity defined between the front base and the front bottom base to elongate or reduce a predetermined distance between a cap mount protrusion and a notched edge. The front cover closes onto the front base, and the rear cover closes, whereby rear cover lateral edges are partially positioned onto first and second channels, and lateral edges relatively align with a base edge.

18 Claims, 5 Drawing Sheets

FITTED CAP CASE

BACKGROUND OF THE INVENTION

1. Field of the Invention

The present invention relates to containers for storing and transporting headwear, and more particularly, to fitted cap cases.

2. Description of the Related Art

Applicant believes that one of the closest references corresponds to U.S. Pat. No. 7,147,112 issued to Alphonia Penson on Dec. 12, 2006 for Stackable hat storage units with multiple mounting elements. However, it differs from the present invention because Penson teaches a stackable hat storage unit having a frame defining a rectangular opening. The stackable hat storage unit has a top, a bottom, left and right side panels, parallel horizontal strings that traverse the opening attached to the left and right side panels, the strings spaced so that a folded cap on the string conceals a portion of a similarly folded cap on an adjacent string, the top panel including a vertical notch to receive a hanger-type hook for mounting the frame onto a crossbar and two vertical wall notches to receive screws projecting from a wall, the top panel of the frame curving forward and projecting downwardly to form a top panel lip covering part of the top panel's height, a top portion of the top panel having an upside down "U" cross-section, the top panel lip fitting over a top edge of the bottom panel of a second frame to form a plurality of frames that function together.

Applicant believes that another reference corresponds to U.S. Pat. No. 6,510,972 issued to Charles E. Briskey on Jan. 28, 2003 for Billed cap storage and shaping device. However, it differs from the present invention because Briskey teaches a storage and shaping device for caps having a bill. The device is comprised of a cavity that is sized to accommodate at least one billed cap. The cavity has an opening on one end that allows for the insertion of caps into the device. A portion of the cavity is provided as a bill shaping structure.

Applicant believes that another reference corresponds to U.S. Pat. No. 6,273,274 issued to Anthony Lyles on Aug. 14, 2001 for Folded cap holder. However, it differs from the present invention because Lyles teaches a cap holder for holding a plurality of folded nested caps having a bill and a foldable crown. The cap holder comprises a frame, a crown support mounted to the frame for holding the nested, folded crowns, and a bill support mounted on the frame, which forms an open pocket to receive the cap bills. The crown support comprises a vertical, curved and outwardly projecting column on the frame to fit in the hollow of a folded cap crown and the bill support comprises a band of material with an arcuate mouth portion spaced from the column to define an open mouth to receive cap the bill.

Applicant believes that another reference corresponds to U.S. Pat. No. 6,125,997 issued to Steven M. Campbell on Oct. 3, 2000 for Baseball cap travel case. However, it differs from the present invention because Campbell teaches a hat travel case including an elongated container body defining a main body portion, a back plate portion, a bill portion and a first enclosed space therein. The main body portion has a main body chamber therein and dimensioned to receive a plurality of billed hats arranged in a shingled array. The billed portion having a bill chamber therein and dimensioned to receive the bill portion of a billed hat. The back plate portion is pivotally connected to the main body portion and allows access to the interior of the travel case so that the plurality of billed hats can be inserted therein. The back plate portion further includes a form preserving means such as a reversed dome attached thereto. The form preserving means secures the plurality of the billed hats and ensures that their shape is maintained.

Applicant believes that another reference corresponds to U.S. Pat. No. 5,813,546 issued to Wilson, et al. on Sep. 29, 1998 for Cap display apparatus. However, it differs from the present invention because Wilson, et al. teach a piece of transparent material having a hollow form extending away from a planar surface. The hollow form has a crown section and a bill section, both sections having a common bottom face. The inner dimensions of the crown section correspond to the outer dimensions of the crown when the back half of the crown is folded in back of the front half of the crown. The inner dimensions of the bill section correspond to the outer dimensions of the bill. A baseball style cap fits within the cavity formed by the crown section and the bill section. Backing material contacts the window piece against its rear surface and can be seen through the window piece. A frame holds the window piece, the backing material, and a rigid back piece together. The entire structure is mounted on a vertical surface such as a wall, for displaying the cap. A secondary display area is created below the hollow form by removing some of the backing material. This secondary display area permits displaying a ticket associated with the cap, or another thin flat object.

Applicant believes that another reference corresponds to U.S. Pat. No. 5,480,023 issued to Alonzo L. Puller on Jan. 2, 1996 for Baseball cap carrying bag. However, it differs from the present invention because Puller teaches a cap container including an elongated container body, a bill container body joined to the elongated container body, and an adjustable frame disposed within the elongated container body. The elongated container body has a front end, rear end, and a wall extending from the front end to the rear end. The wall is made of a supple material, such as cloth, and defines an elongated chamber within the elongated container body. The bill container body defines a cavity, which together with the elongated chamber of the elongated container body allow for the compact storage of visored, baseball-type caps in a shingled arrangement. The frame prevents the caps from being crushed and also supports the supple wall. The supple wall in conjunction with the adjustable frame allows the length of the container to vary in order to accommodate the storage of varying numbers of caps. The adjustable nature of container ensures optimum utilization of available storage space. As the number of caps stored in the container is reduced, the volume occupied by the container may also be reduced. The outer surface of the bill container body includes a cloth covered surface, which resembles the bill and convex front portion of a baseball cap. The material and decorative design of the outer surface may be selected to match the design of the caps stored in the container.

Applicant believes that another reference corresponds to U.S. Pat. No. 5,348,166 issued to Greg Lema on Sep. 20, 1994 for Ball cap storage rack. However, it differs from the present invention because Lema teaches a ball cap storage rack having a wire or rod stock frame including a plurality of rods configured to form an elongated, generally rectangular-shaped back with side capture bars and a pair of hooks at one end. The back has a width slightly narrower than the width of a typical baseball cap visor and is adapted to have its length running vertically when in normal use. Two additional sets of rods are arrayed along opposite sides of the back to form side capture rails, and define visor edge receiving openings. The upper ends of the rails are deformed to provide a closet pole hanger at the upper end of the rack, and the lower ends are deformed to form the capture fingers at a lower portion of the device. To store a plurality of baseball caps in the rack, the caps are placed with their visors flat against the back with the soft cap portion collapsed forwardly and the bill of each successive cap slipped behind the preceding one and the folded cap nested against the same part of the preceding cap. The visor edges protrude through openings in the rack sides. The caps are restrained in the rack by capture fingers at the lower ends of the side rails.

Applicant believes that another reference corresponds to U.S. Pat. No. 5,022,515 issued to Anthony Agostine on Jun. 11, 1991 for Hat container. However, it differs from the present invention because Agostine teaches a hat storage container wherein outer walls define a body and a bill, enclosing a space comprising a main body chamber and a bill-shaped chamber adapted to receiving a hat bill. The main body chamber is adapted to receive the main body portions of one or more corresponding billed hats. Preferably, the main body chamber is longer than the main body portions of the hats to be stored therein, whereby the main body chamber is adapted to receive a shingled array of a plurality of the hats; and the bill-receiving chamber is adapted to receive the corresponding shingled array of bills.

Applicant believes that another reference corresponds to U.S. Pat. No. D544,207 issued to James S. Lindars on Jun. 12, 2007 for Multi-cap carrier. However, it differs from the present invention because Lindars teaches a different ornamental design for a multi-cap carrier.

Other patents describing the closest subject matter provide for a number of more or less complicated features that fail to solve the problem in an efficient and economical way. None of these patents suggest the novel features of the present invention.

SUMMARY OF THE INVENTION

The present invention is a fitted cap case, comprising a cap cover assembly having a front cover and a rear cover, a cap base assembly having a front base and a rear base, and a bottom base assembly having a front bottom base and a rear bottom base. The front cover closes onto the front base.

The front cover comprises a top panel, a front panel, lateral sides with respective lateral edges, and a rear edge. The front cover further comprises a visor top panel and a visor front face with a hinge. The rear cover comprises a rear top panel, rear lateral sides with respective rear cover lateral edges, and a rear panel. The rear panel comprises a rear hinge. The front base comprises a base top face, a base front face, base lateral sides, a front base rear edge, and a front base bottom face. The front base further comprises a base edge, and first and second base interior lateral sides. The first and second base interior lateral sides and the base top face define first and second channels that extend a predetermined distance from the front base rear edge. The front base rear edge comprises a notched edge defining a first predetermined angle. The rear base comprises a rear base top face, rear base lateral edges, a rear base front edge, and a base rear edge. Extending from the rear base top face is a cap mount protrusion defining a second predetermined angle. The first predetermined angle of the notched edge and the second predetermined angle of the cap mount protrusion are approximately equal.

The rear base lateral edges each comprise a rear base lip and a lateral tab respectively. The visor front face is hingedly connected to the base front face by the hinge, and the rear panel is hingedly connected to the base rear edge by the rear hinge. The front bottom base comprises a top face, a front edge, and lateral edges. The rear bottom base comprises a rear top face, and rear lateral edges having first and second tabs. The front bottom base is fixed to the front base, and the rear bottom base is fixed to the rear base.

The rear base and the rear bottom base slide within a cavity defined between the front base and the front bottom base to elongate or reduce a predetermined distance between the cap mount protrusion and the notched edge. The front cover closes onto the front base, and the rear cover closes, whereby the rear cover lateral edges are partially positioned onto the first and second channels respectively, and the lateral edges relatively align with the base edge.

It is therefore one of the main objects of the present invention to provide a fitted cap case.

It is another object of this invention to provide a fitted cap case, which has an adjustable length.

It is another object of this invention to provide a fitted cap case, to store and/or carry caps.

It is another object of this invention to provide a fitted cap case that is volumetrically efficient for carrying, transporting, and storage.

It is another object of this invention to provide a fitted cap case, which is of a durable and reliable construction.

It is yet another object of this invention to provide a fitted cap case that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
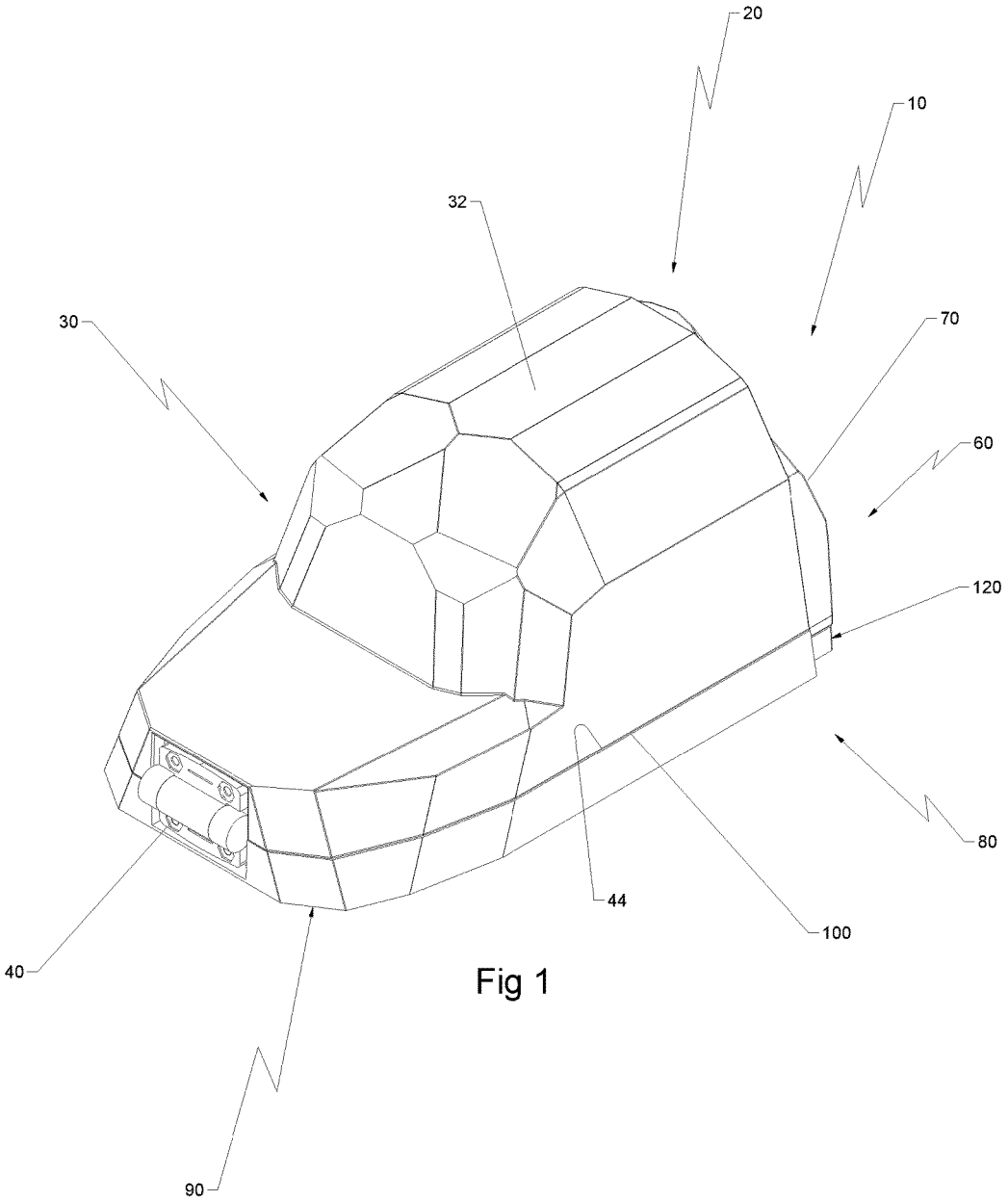
FIG. 1 is an isometric view of the present invention in a closed and shortened configuration.

Referring now to the drawings, the present invention is a fitted cap case, and is generally referred to with numeral 10. It can be observed that it basically includes cap cover assembly 20, cap base assembly 80, and bottom base assembly 150.

As seen in FIG. 1, cap cover assembly 20 comprises front cover 30 and rear cover 60, and cap base assembly 80 comprises front base 90 and rear base 120. Front cover 30 is connected to front base 90 by hinge 40, and rear cover 60 is connected to rear base 120 by rear hinge 68, seen in FIG. 2.

Figure 2:
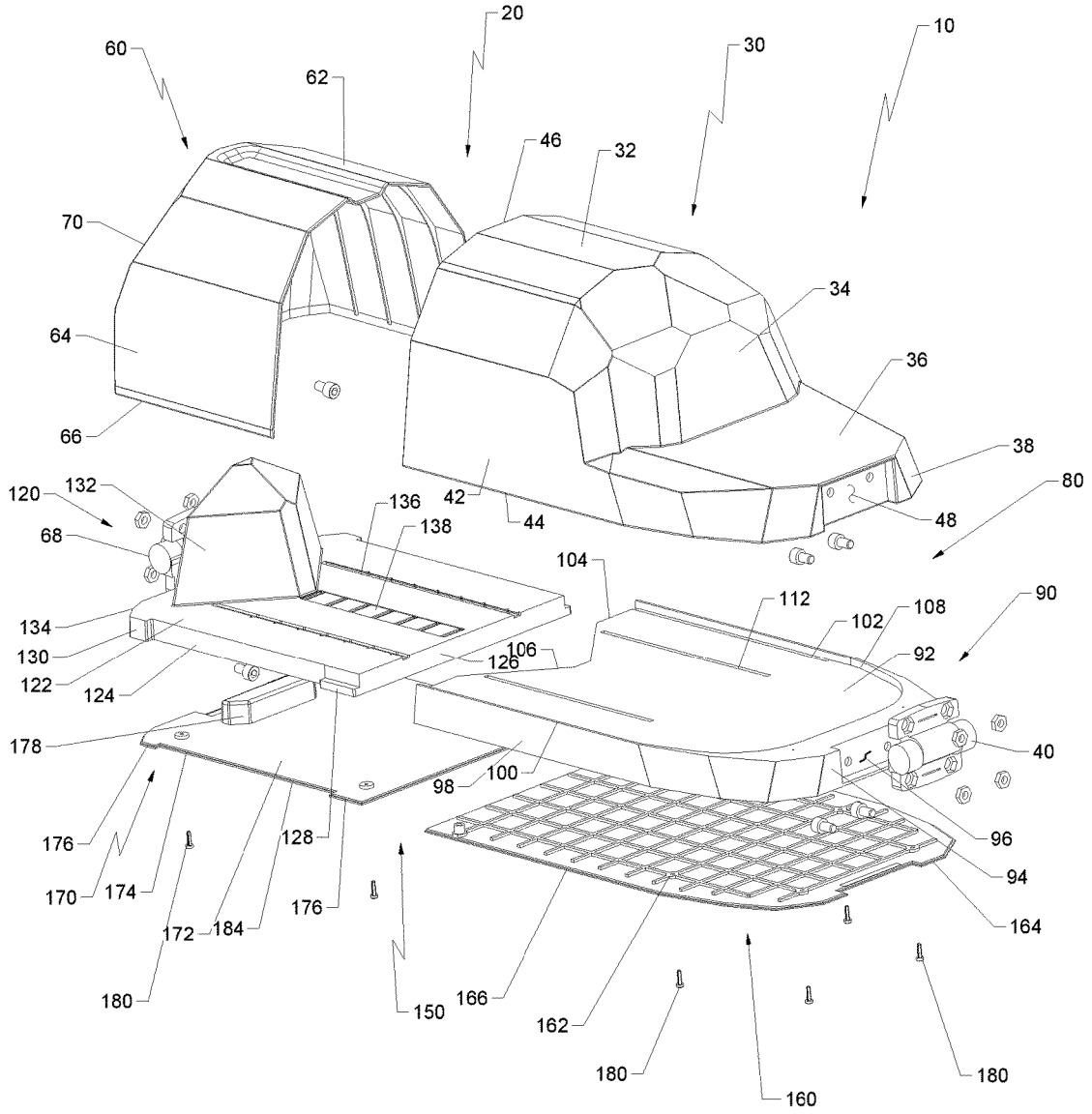
FIG. 2 is a first exploded view of the present invention.

In the illustrated embodiment, fitted cap case 10 is in a shortened configuration, wherein rear base 120, fixed to rear bottom base 170 as seen in FIG. 2, is almost completely positioned inside a cavity defined between front base 90 and front bottom base 160 seen in FIG. 2.

Figure 3:
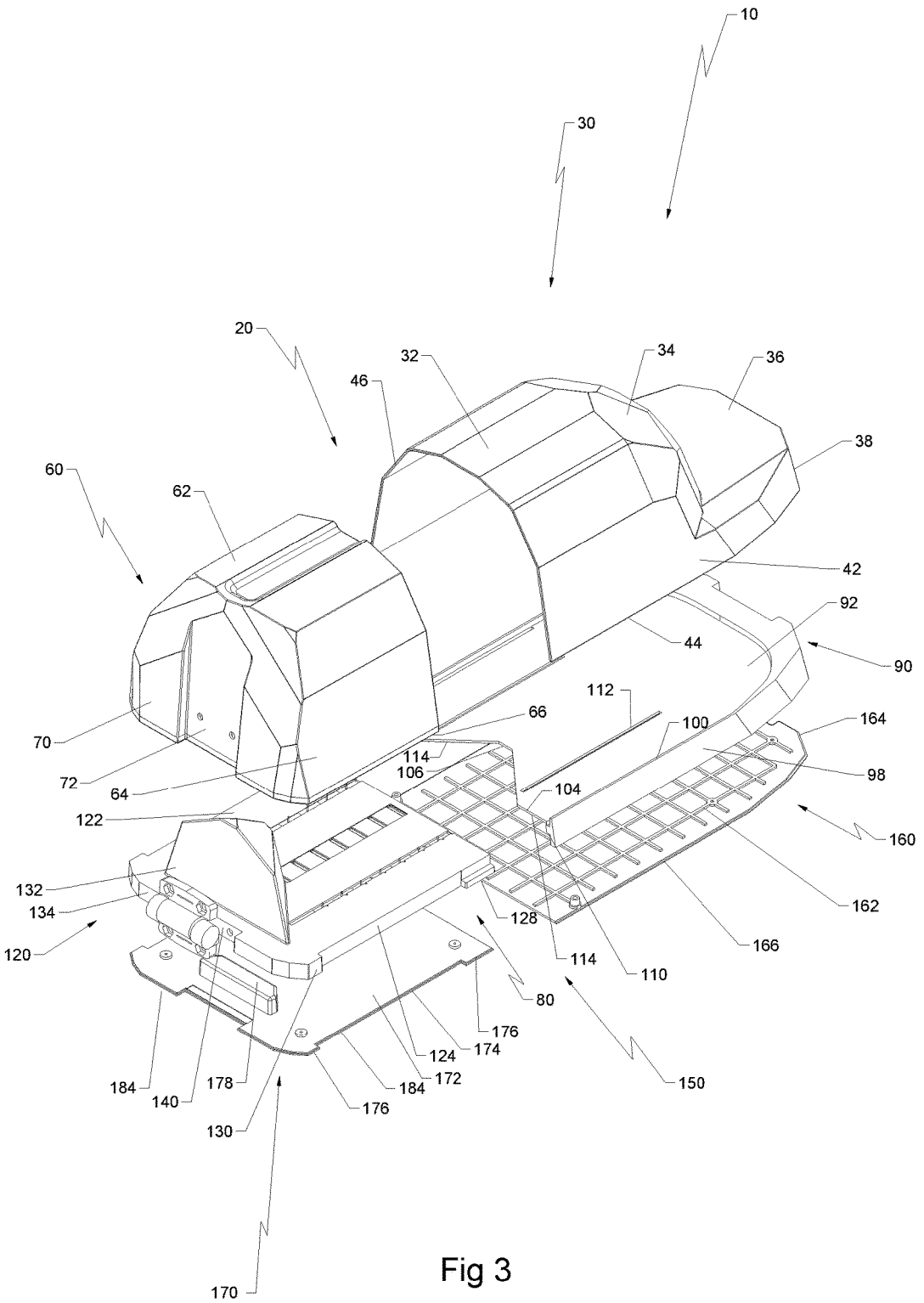
FIG. 3 is a second exploded view of the present invention.

As seen in FIGS. 2 and 3, front cover 30 comprises top panel 32, front panel 34, lateral sides 42, and rear edge 46. Lateral sides 42 each comprise a respective lateral edge 44. Front cover 30 further comprises visor top panel 36 and visor front face 38. Visor front face 38 has hinge cavity 48 wherein is secured hinge 40. Rear cover 60 comprises rear top panel 62, rear lateral sides 64, and rear panel 70. Rear lateral sides 64 each comprise a respective rear cover lateral edge 66. Rear panel 70 has hinge indent 72 wherein is secured rear hinge 68.

Front base 90 comprises base top face 92, base front face 94, base lateral sides 98, and front base rear edge 104. Base front face 94 comprises hinge cavity 96 wherein hinge 40 is secured. Front base 90 further comprises base edge 100 and first and second base interior lateral sides 108. First and second base interior lateral sides 108, and base top face 92 define first and second channels 102, which extend a predetermined distance from front base rear edge 104. Front base rear edge 104 comprises notched edge 106 defining a first predetermined angle. Base top face 92 comprises first and second slits 112 extending a predetermined distance onto its surface. Rear base 120 comprises rear base top face 122, rear base lateral edges 124, rear base front edge 126, and base rear edge 134. Extending from rear base top face 122 is cap mount protrusion 132, defining a second predetermined angle, wherein the first predetermined angle of notched edge 106 and the second predetermined angle of cap mount protrusion 132 are approximately equal. Rear base lateral edges 124 each define a respective rear base lip 128, and lateral tab 130. Base rear edge 134 comprises base hinge indent 140 wherein rear hinge 68 is secured. Rear base top face 122 further comprises base elongated slits 136, and a plurality of base slits 138 that are perpendicularly positioned with respect to elongated slits 136.

Bottom base assembly 150 comprises front bottom base 160 and rear bottom base 170. Front bottom base 160 comprises top face 162, front edge 164, and lateral edges 166. Rear bottom base 170 comprises rear top face 172 and rear lateral edges 174. Rear top face 172 has handle protrusion 178, which extends from a handle positioned on bottom face 184. Rear lateral edges 174 each comprise respective first and second tabs 176. Front bottom base 160 is fixed to front base 90 and rear bottom base 170 is fixed to rear base 120, whereby respective first and second tabs 176 relatively align with respective rear base lips 128 and lateral tabs 130. In a preferred embodiment, front bottom base 160 is fixed to front base 90, and rear bottom base 170 is fixed to rear base 120 with screws 180. Rear base 120 fixed to rear bottom base 170 slide within a cavity defined between front base bottom face 114 and top face 162, whereby rear base lips 128 relatively align with base notch 110 and slide there through a predetermined distance.

Figure 4:
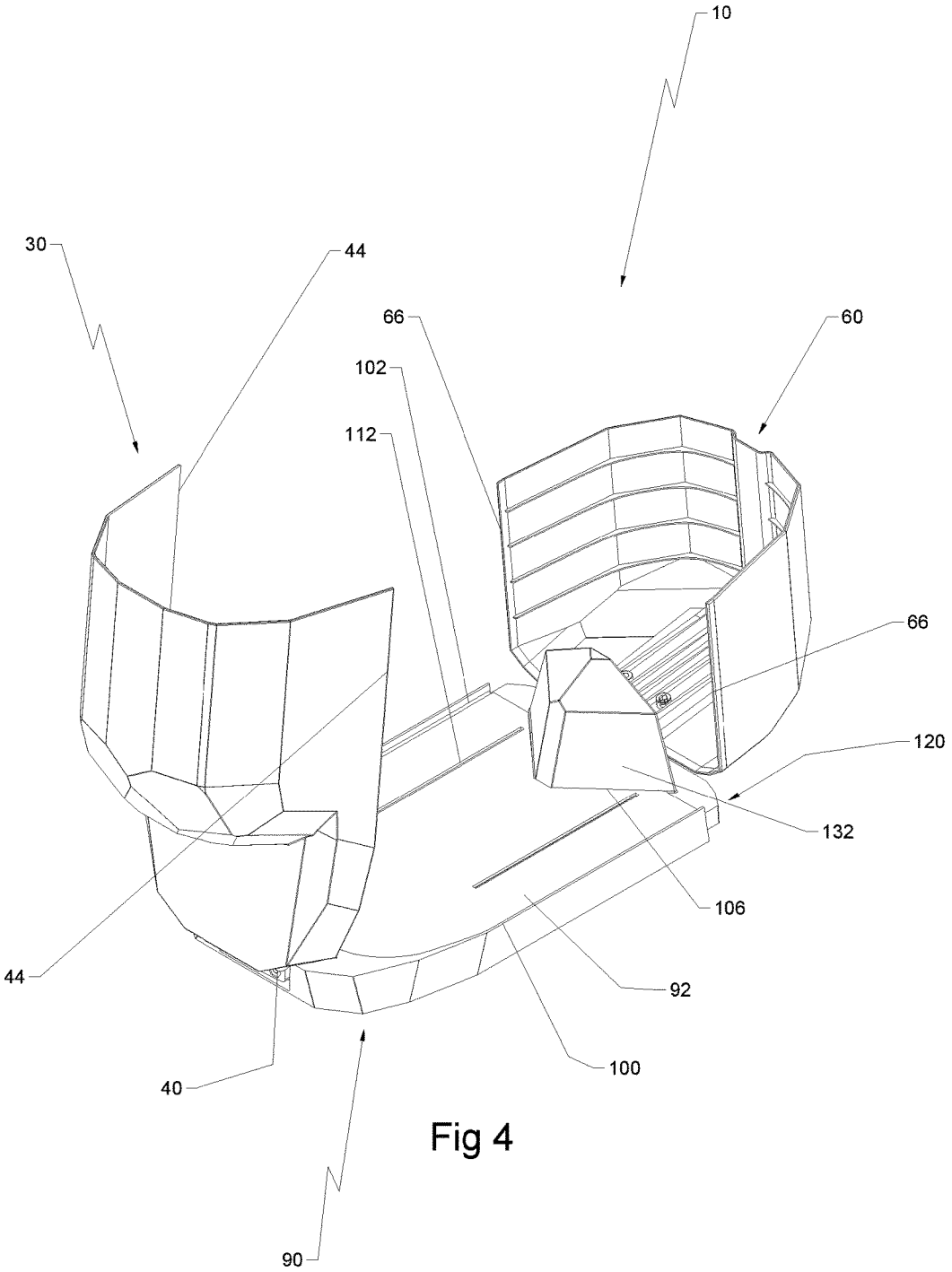
FIG. 4 is an isometric view of the present invention in an opened and shortened configuration.
Figure 5:
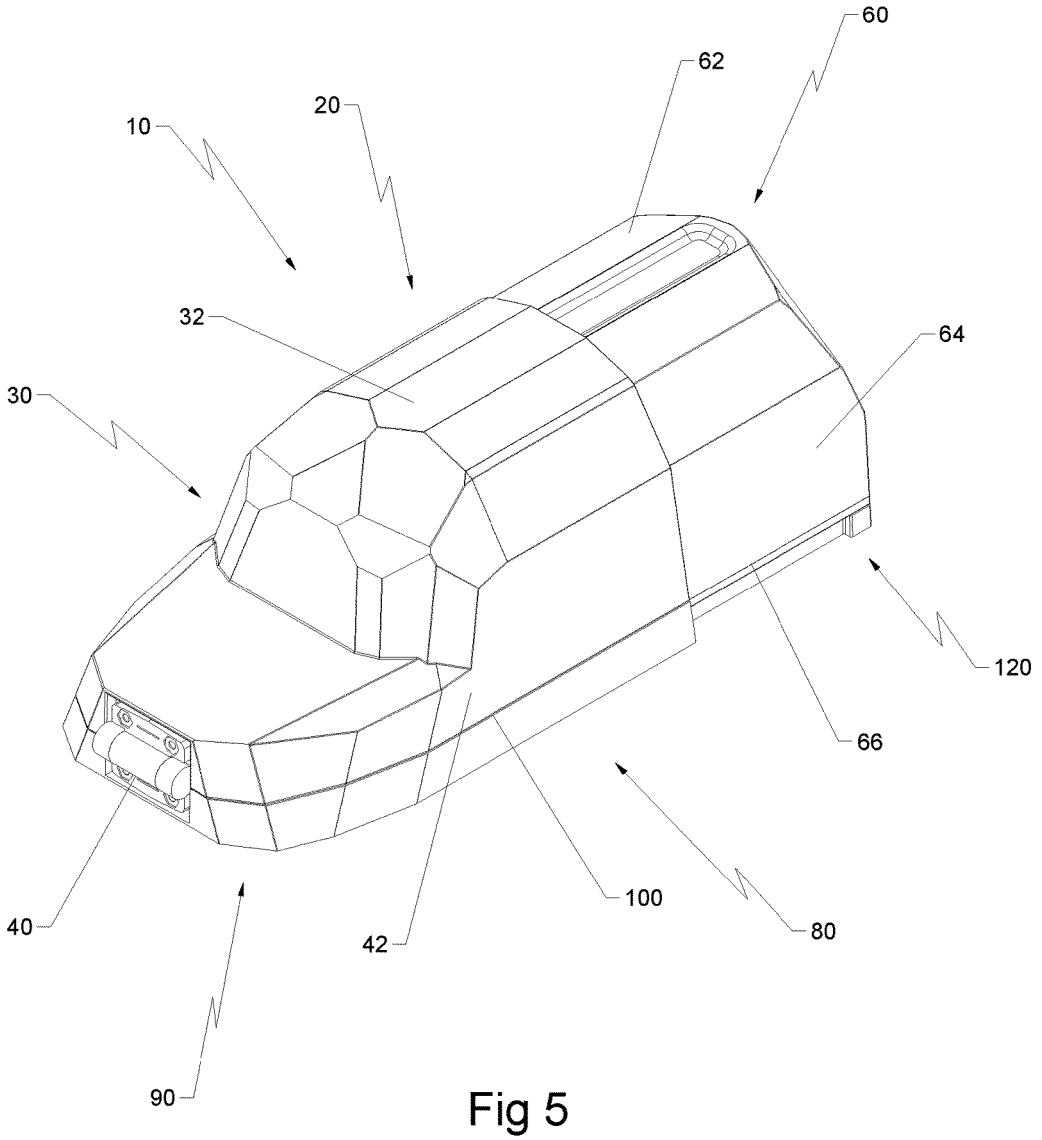
FIG. 5 is an isometric view of the present invention in a closed and elongated configuration.

As seen in FIGS. 4 and 5, front cover 30 is hingedly connected to front base 90, and rear cover 60 is hingedly connected to rear base 120, allowing that front cover 30 and rear cover 60 may be opened or closed onto front base 90 or rear base 120.

In a preferred embodiment, rear cover 60 first closes, whereby rear cover lateral edges 66 are partially positioned onto respective channels 102. Front cover 30 mounts complete or partially onto rear cover 60 when closed onto front base 90, and respective lateral edges 44 relatively align with base edge 100. Rear cover 60 may close completely or partially onto rear base 120 or onto front base 90.

In addition, rear base 120 fixed to rear bottom base 170 seen in FIG. 2, slides within a cavity defined between front base 90 and front bottom base 160 seen in FIG. 2, to elongate or reduce a predetermined distance between cap mount protrusion 132 and notched edge 106, and therefore increasing or reducing a capacity inside fitted cap case 10.

In the shortened configuration as illustrated in FIG. 4, rear base 120 fixed to rear bottom base 170 seen in FIG. 2, slides within a cavity defined between front base 90 and front bottom base 160 until notched edge 106 contacts cap mount protrusion 132.

Fitted cap case 10 may also have an elongated configuration as seen in FIG. 5, wherein rear base 120 fixed to rear bottom base 170 as seen in FIG. 2, extends outside of the cavity defined between front base 90 and front bottom base 160 without detaching therefrom. In the illustrated embodiment, rear cover 60 closes onto rear base 120 and front cover 30 slightly mounts onto rear cover 60.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A fitted cap case, comprising:

A) a cap cover assembly having a front cover and a rear cover, said front cover comprises a top panel, a front panel, lateral sides with respective lateral edges, a rear edge, a visor top panel and a visor front face with a hinge;

B) a cap base assembly having a front base and a rear base; and

C) a bottom base assembly having a front bottom base and a rear bottom base, wherein said front cover closes onto said front base.

2. The fitted cap case set forth in claim 1, further characterized in that said rear cover comprises a rear top panel, rear lateral sides with respective rear cover lateral edges, and a rear panel.

3. The fitted cap case set forth in claim 2, further characterized in that said rear panel comprises a rear hinge.

4. The fitted cap case set forth in claim 3, further characterized in that said front base comprises a base top face, a base front face, base lateral sides, a front base rear edge, and a front base bottom face.

5. The fitted cap case set forth in claim 4, further characterized in that said front bottom base comprises a top face, a front edge, and lateral edges.

6. The fitted cap case set forth in claim 4, further characterized in that said front base rear edge comprises a notched edge defining a first predetermined angle.

7. The fitted cap case set forth in claim 6, further characterized in that said rear base comprises a rear base top face, rear base lateral edges, a rear base front edge, and a base rear edge.

8. The fitted cap case set forth in claim 7, further characterized in that said visor front face is hingedly connected to said base front face by said hinge, and said rear panel is hingedly connected to said base rear edge by said rear hinge.

9. The fitted cap case set forth in claim 7, further characterized in that said rear base lateral edges each comprise a rear base lip and a lateral tab respectively.

10. The fitted cap case set forth in claim 7, further characterized in that extending from said rear base top face is a cap mount protrusion defining a second predetermined angle.

11. The fitted cap case set forth in claim 10, further characterized in that said rear base and said rear bottom base slide within a cavity defined between said front base and said front bottom base to elongate or reduce a predetermined distance between said cap mount protrusion and said notched edge.

12. The fitted cap case set forth in claim 10, further characterized in that said first predetermined angle of said notched edge and said second predetermined angle of said cap mount protrusion are approximately equal.

13. The fitted cap case set forth in claim 4, further characterized in that said front base further comprises a base edge, and first and second base interior lateral sides.

14. The fitted cap case set forth in claim 13, further characterized in that said first and second base interior lateral sides and said base top face define first and second channels that extend a predetermined distance from said front base rear edge.

15. The fitted cap case set forth in claim 14, further characterized in that said front cover closes onto said front base, and said rear cover closes, whereby said rear cover lateral edges are partially positioned onto said first and second channels respectively, and said lateral edges relatively align with said base edge.

16. The fitted cap case set forth in claim 1, further characterized in that said rear bottom base comprises a rear top face, and rear lateral edges having first and second tabs.

17. The fitted cap case set forth in claim 1, further characterized in that said front bottom base is fixed to said front base, and said rear bottom base is fixed to said rear base.

18. The fitted cap case set forth in claim 1, further characterized in that said rear base and said rear bottom base slide within a cavity defined between said front base and said front bottom base.

* * * * *